United States Patent [19]

Veigel

[11] 4,120,546

[45] Oct. 17, 1978

[54] ROTARY FILE

[75] Inventor: Orin C. Veigel, Afton, Wyo.

[73] Assignee: The Raymond Lee Organization, Inc., New York, N.Y. ; a part interest

[21] Appl. No.: 850,720

[22] Filed: Nov. 11, 1977

[51] Int. Cl.[2] ..... A47B 49/00

[52] U.S. Cl. ..... 312/134; 312/268

[58] Field of Search ..... 312/186, 223, 267, 268, 312/305, 134, 97

[56] References Cited

U.S. PATENT DOCUMENTS

| | | | |
|---|---|---|---|
| 764,280 | 7/1904 | Durr et al. | 312/97 |
| 919,927 | 4/1909 | Neumann et al. | 312/134 |
| 2,784,045 | 3/1957 | Ormaetxea et al. | 312/305 |

*Primary Examiner*—Casmir A. Nunberg
*Attorney, Agent, or Firm*—Daniel Jay Tick

[57] ABSTRACT

An endless belt is mounted on, and extends between, a pair of elongated rollers rotatably mounted in a housing in spaced parallel relation parallel to, and in proximity with, the top and bottom of the housing. A plurality of shelf members are affixed to the belt and extend perpendicularly from the belt in spaced parallel relation for releasably storing files between next-adjacent shelf members. A motor coupled to one of the rollers rotates the rollers and the belt to move the shelf members cyclically from top to bottom to top inside the housing. An opening is formed in the front of the housing and covered by a selectively openable door to provide access to the shelf members for inserting and removing files.

1 Claim, 3 Drawing Figures

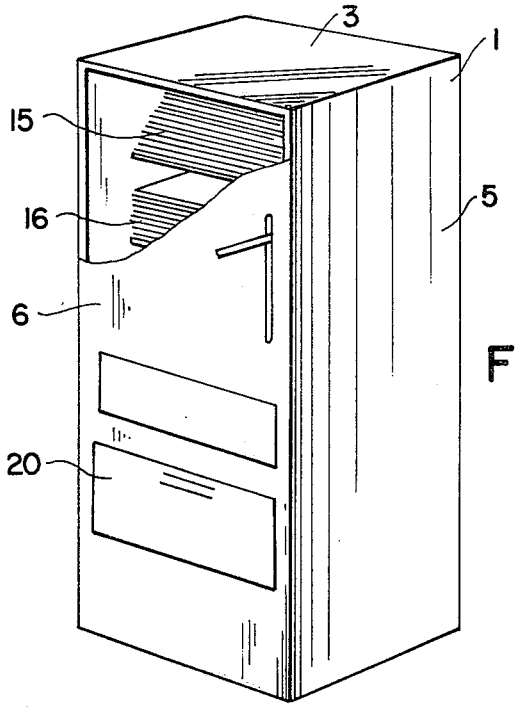
FIG. 1
FIG. 2
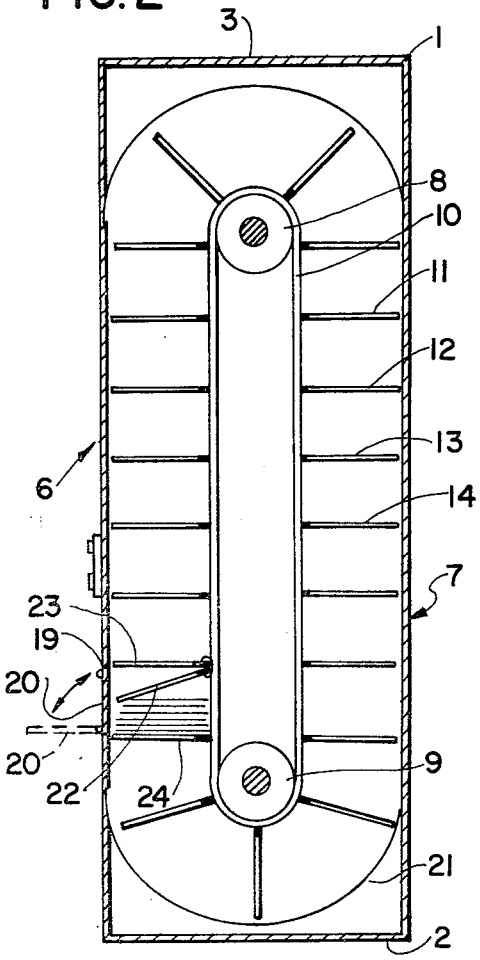
FIG. 3
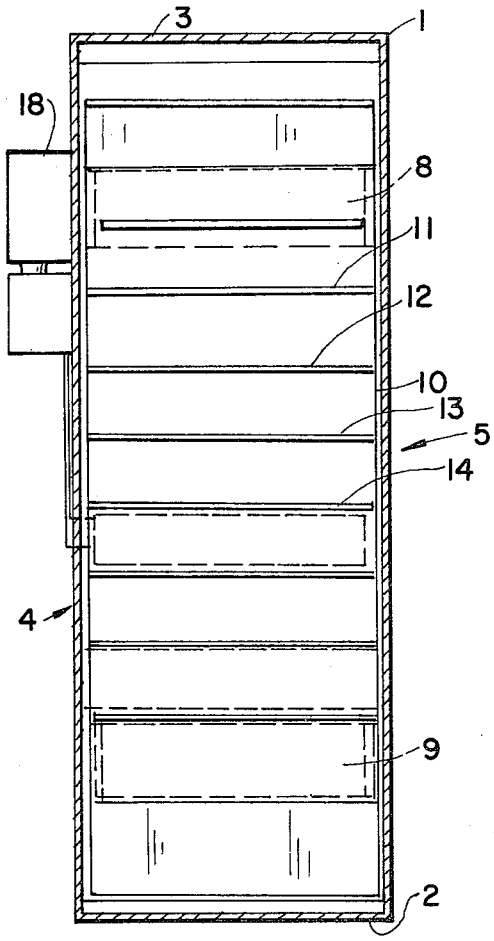

ROTARY FILE

BACKGROUND OF THE INVENTION

The present invention relates to a rotary file.

Rotary files are disclosed in the following U.S. patents. U.S. Pat. No. 2,575,745, issued to Carlson on Nov. 20, 1951, U.S. Pat. No. 2,761,750, issued to Neilsen on Sept. 4, 1956, U.S. Pat. No. 2,784,045, issued to de Ormaetxea et al. on Mar. 5, 1957, U.S. Pat. No. 2,796,308, issued to Knittel on June 18, 1957, U.S. Pat. No. 2,928,706, issued to Abbott et al. on Mar. 15, 1960 and U.S. Pat. No. 2,975,014, issued to Dahl on Mar. 14, 1961.

Objects of the invention are to provide a rotary file of simple structure, which is inexpensive in manufacture, used with facility and convenience, stores a maximum number of files in a minimum space, provides immediate access to such files, and functions efficiently, effectively and reliably as a safe and secure depository for papers of all types.

BRIEF DESCRIPTION OF THE DRAWINGS

In order that the invention may be readily carried into effect, it will now be described with reference to the accompanying drawings, wherein:

FIG. 1 is a perspective view, partly cut away, of an embodiment of the rotary file of the invention;

FIG. 2 is a side view, on an enlarged scale, with a side removed, of the embodiment of FIG. 1; and FIG. 3 is a front view, on an enlarged scale, with the front removed, of the embodiment of FIG. 1.

DETAILED DESCRIPTION OF THE INVENTION

The rotary file of the invention comprises a housing 1 having a bottom 2, a top 3 spaced from the bottom and substantially parallel thereto, and a pair of spaced substantially parallel sides 4 and 5 joining the top 3 and the bottom 2 and substantially perpendicular thereto (FIG. 3). The housing 1 has a front 6 (FIGS. 1 and 2) joining the top 3, the bottom 2 and the sides 4 and 5 and substantially perpendicular thereto and a back 7 (FIG. 2) joining said top, said bottom and said sides and substantially perpendicular thereto and in spaced substantially parallel relation with the front 6.

A pair of elongated cylindrical rollers 8 and 9 are rotatably mounted in the housing 1 in spaced parallel relation parallel to the top 3 and the bottom 2, as shown in FIGS. 2 and 3. The roller 8 is in proximity with the top 3 of the housing 1 and the roller 9 is in proximity with the bottom 2 of said housing.

An endless belt 10 is mounted on, and extends between, the rollers 8 and 9, as shown in FIGS. 2 and 3, and is rotatable with said rollers.

A plurality of shelf members 11, 12, 13, 14, and so on (FIGS. 2 and 3), are affixed to the belt 10 and extend substantially perpendicularly from the belt in spaced substantially parallel relation, as shown in FIGS. 2 and 3, for releasably storing files 15, 16, and the like (FIG. 1) between next-adjacent shelf members.

A motor 18 (FIG. 3) is coupled to the roller 8 for rotating said roller and the roller 9 and thereby rotating the belt 10 to move the shelf members 10 to 14, and so on, cyclically from top to bottom to top inside the housing 1.

An opening 19 if formed in the front 6 of the housing 1 and is covered by a selectively openable door 20 to provide access to the shelf members 11 to 14, and so on, for inserting and removing files.

As shown in FIG. 2, a semicylindrical guide sheet 21 is provided at the bottom of the housing 1 to prevent files 15, 16, and the like, from falling out from between the shelf members at the bottom of the cycle.

A plurality of spring-biased follower members are affixed to the shelf member for releasably clamping files stored between next-adjacent shelf members. Thus, as shown in FIG. 2, a spring-biased follower member 22 is affixed to a shelf member 23 for releasably clamping files stored between the next-adjacent shelf members 23 and 24.

The motor 18 may be replaced by a manually operated motive system for rotating the belt 10.

While the invention has been described by means of a specific example and in a specific embodiment, I do not wish to be limited thereto, for obvious modifications will occur to those skilled in the art without departing from the spirit and scope of the invention.

I claim:

1. A rotary file, comprising a housing having a bottom, a top spaced from the bottom and substantially parallel thereto, a pair of spaced substantially parallel sides joining the top and bottom and substantially perpendicular thereto, a front joining the top, bottom and sides and substantially perpendicular thereto, and a back joining the top, bottom and sides and substantially perpendicular thereto and in spaced substantially parallel relation with the front;

a pair of elongated cylindrical rollers rotatably mounted in the housing in spaced parallel relation parallel to the top and bottom, one of the rollers being in proximity with the top of the housing and the other of the roller being in proximity with the bottom of the housing;

an endless belt mounted on and extending between the rollers and rotatable therewith;

a plurality of shelf members affixed to the belt and extending substantially perpendicularly from said belt in spaced substantially parallel relation for releasably storing files between next-adjacent shelf members;

motive means coupled to one of the rollers for rotating said rollers and thereby rotating said belt to move said shelf members cyclically from top to bottom to top inside the housing;

an opening formed in the front of the housing and covered by a selectively openable door to provide access to the shelf member for inserting and removing files;

a substantially semicylindrical guide sheet at the bottom of the housing to prevent files from falling out from between the shelf members at the bottom of the cycle; and a plurality of spring-biased follower members affixed to the shelf members for releasably clamping files stored between next-adjacent shelf members, each of said follower members being pivotally coupled to a corresponding one of said shelf members and having a spring urging it toward a next-adjacent one of said shelf members.

* * * * *